US010378307B2

(12) United States Patent
Allen et al.

(10) Patent No.: US 10,378,307 B2
(45) Date of Patent: Aug. 13, 2019

(54) PERMEABLE LOST CIRCULATION DRILLING LINER

(71) Applicant: Saudi Arabian Oil Company, Dhahran (SA)

(72) Inventors: John Timothy Allen, Dhahran (SA); Brett Bouldin, Dhahran (SA)

(73) Assignee: Saudi Arabian Oil Company (SA)

( * ) Notice: Subject to any disclaimer, the term of this patent is extended or adjusted under 35 U.S.C. 154(b) by 0 days.

(21) Appl. No.: 15/956,449

(22) Filed: Apr. 18, 2018

(65) Prior Publication Data

US 2018/0230771 A1 Aug. 16, 2018

Related U.S. Application Data

(63) Continuation of application No. 15/139,486, filed on Apr. 27, 2016, now Pat. No. 9,995,108, which is a (Continued)

(51) Int. Cl.

| | |
|---|---|
| ***E21B 43/10*** | (2006.01) |
| ***E21B 33/138*** | (2006.01) |
| ***E21B 21/00*** | (2006.01) |

(52) U.S. Cl.

CPC ..... *E21B 33/138* (2013.01); *E21B 21/003* (2013.01); *E21B 43/103* (2013.01); *E21B 43/108* (2013.01)

(58) Field of Classification Search

CPC ..... E21B 43/103; E21B 33/138; E21B 21/003

(Continued)

(56) References Cited

U.S. PATENT DOCUMENTS

| | | | |
|---|---|---|---|
| 1,629,018 | A | 5/1927 | Coberly |
| 2,626,779 | A | 1/1953 | Armentrout |

(Continued)

FOREIGN PATENT DOCUMENTS

| | | | |
|---|---|---|---|
| FR | 2901837 | A1 | 12/2007 |
| GB | 2395214 | A | 5/2004 |

(Continued)

OTHER PUBLICATIONS

International Search Report and Written Opinion, PCT/US2012/055413, dated Feb. 20, 2014.

(Continued)

*Primary Examiner* — Zakiya W Bates
*Assistant Examiner* — Ashish K Varma
(74) *Attorney, Agent, or Firm* — Bracewell LLP; Constance G. Rhebergen

(57) ABSTRACT

A layer of permeable material is positioned on an area of lost circulation lithology in a wellbore. An example of the permeable material includes a planar member with perforations that is rolled into and retained in an annular configuration. The permeable material is lowered into the wellbore adjacent the area of lost circulation and allowed to unroll and expand radially outward against walls of the wellbore. The wellbore wall along the area of lost circulation lithology can be reamed out so the layer of permeable material is out of the way of a drill bit. Applying a bridging agent on the interface where the permeable material contacts the wellbore wall forms a flow barrier.

13 Claims, 4 Drawing Sheets

Related U.S. Application Data continuation of application No. 13/621,927, filed on Sep. 18, 2012, now Pat. No. 9,353,584.

(60) Provisional application No. 61/536,797, filed on Sep. 20, 2011.

(58) Field of Classification Search
USPC ..... 166/292
See application file for complete search history.

(56) References Cited

U.S. PATENT DOCUMENTS

| | | | | |
|---|---|---|---|---|
| 2,944,018 | A * | 7/1960 | Borcherdt | E21B 21/003 507/117 |
| 3,134,442 | A * | 5/1964 | Jennings | E21B 29/10 166/148 |
| 3,203,483 | A | 8/1965 | Vincent | |
| 3,477,506 | A | 11/1969 | Malone | |
| 4,287,952 | A | 9/1981 | Erbstoesser | |
| 5,049,003 | A | 9/1991 | Barton | |
| 5,119,862 | A | 6/1992 | Maimets et al. | |
| 5,186,215 | A | 2/1993 | Gilleland | |
| 5,334,429 | A | 8/1994 | Imoto et al. | |
| 5,366,012 | A | 11/1994 | Lohbeck | |
| 5,375,662 | A | 12/1994 | Echols, III et al. | |
| 5,667,011 | A | 9/1997 | Gill et al. | |
| 5,725,328 | A | 3/1998 | Schmager | |
| 5,901,789 | A | 5/1999 | Donnelly et al. | |
| 6,012,522 | A | 1/2000 | Donnelly et al. | |
| 6,250,385 | B1 | 6/2001 | Montaron | |
| 6,516,506 | B2 | 2/2003 | Donnelly et al. | |
| 6,775,894 | B2 | 8/2004 | Hardin | |
| 7,350,565 | B2 | 4/2008 | Hall et al. | |
| 7,380,595 | B2 | 6/2008 | Wetzel et al. | |
| 9,353,584 | B2 | 5/2016 | Allen et al. | |
| 2002/0162664 | A1 | 11/2002 | Bode et al. | |
| 2003/0015246 | A1 | 1/2003 | Hardin | |
| 2004/0055758 | A1 | 3/2004 | Brezinski et al. | |
| 2005/0023002 | A1 | 2/2005 | Zamora et al. | |
| 2006/0016597 | A1 | 1/2006 | Emerson | |
| 2007/0017669 | A1 | 1/2007 | Lurie | |
| 2007/0029086 | A1 * | 2/2007 | East, Jr. | E21B 43/04 166/278 |
| 2009/0206817 | A1 | 8/2009 | Ng et al. | |
| 2010/0032169 | A1 | 2/2010 | Adam et al. | |
| 2010/0116495 | A1 | 5/2010 | Spray | |
| 2011/0056703 | A1 | 3/2011 | Eriksen | |
| 2016/0237778 | A1 | 8/2016 | Allen et al. | |

FOREIGN PATENT DOCUMENTS

| | | | |
|---|---|---|---|
| WO | 2002052124 | A2 | 7/2002 |
| WO | 20070106429 | A2 | 9/2007 |

OTHER PUBLICATIONS

International Search Report and Written Opinion, PCT/US2012/055474, dated Aug. 28, 2013.

* cited by examiner

PERMEABLE LOST CIRCULATION DRILLING LINER

CROSS REFERENCE TO RELATED APPLICATIONS

This application is a continuation of, and claims priority to and the benefit of, U.S. patent application Ser. No. 15/139,486, filed Apr. 27, 2016, which claimed priority from and the benefit of U.S. patent application Ser. No. 13/621,927, filed Sep. 18, 2012, which claimed priority from and the benefit of U.S. Provisional Application Ser. No. 61/536,797, filed Sep. 20, 2011, the full disclosures of which are incorporated by reference for all purposes.

BACKGROUND

1. Field

The present disclosure relates to repairing lost circulation zones in a wellbore. More specifically, the disclosure relates to restoring a lost circulation zone in a wellbore with an annular member with side walls having perforations.

2. Related Art

Hydrocarbon producing wellbores extend subsurface and intersect subterranean formations where hydrocarbons are trapped. The wellbores are created by drill bits that are on the end of a drill string, where typically a top drive above the opening to the wellbore rotates the drill string and bit. Cutting elements are usually provided on the drill bit that scrape the bottom of the wellbore as the bit is rotated and excavate material thereby deepening the wellbore. Drilling fluid is typically pumped down the drill string and directed from the drill bit into the wellbore; where the drilling fluid then flows back up the wellbore in an annulus between the drill string and walls of the wellbore. Cuttings are produced while excavating and are carried up the wellbore with the circulating drilling fluid.

While drilling the wellbore mudcake typically forms along the walls of the wellbore that results from residue from the drilling fluid and/or drilling fluid mixing with the cuttings or other solids in the formation. The permeability of the mudcake generally isolates fluids in the wellbore from the formation. Seepage of fluid through the mudcake can be tolerated up to a point. Occasionally cracks form in a wall of the wellbore, where the cracks generally are from voids in the rock formation that were intersected by the bit. Cracks in the wellbore wall sometimes can also form due to differences in pressure between the formation and the wellbore. Fluid flowing from the wellbore into the formation is generally referred to as lost circulation. If the cracks are sufficiently large, they may allow a free flow of fluid between the wellbore and any adjacent formation. If the flow has a sufficient volumetric flow rate, well control can be compromised thereby requiring corrective action.

SUMMARY

A method of operations in a wellbore having a lost circulation zone includes providing a layer of material that is retained in an annular configuration and that has perforations, disposing the layer of material in the wellbore and adjacent the lost circulation zone, expanding the layer of material radially outward and into contact with the lost circulation zone to define a tubular member having an inner radius and an outer radius, and injecting fluid within the inner radius that has particles of a bridging agent entrained within and that accumulate in the perforations to block flow through the perforations and form a flow barrier across the layer of material. In an embodiment, the bridging agent forms a mudcake along the inner radius of the tubular member. The bridging agent can include calcium carbonite. In an alternative, when a pressure in a formation adjacent the lost circulation zone exceeds a pressure in the wellbore, the particles are urged from the perforations to enable flow from the outer radius to the inner radius and remove the flow barrier from across the layer of material, and the layer of material remains in contact with the lost circulation zone, where when the pressure in the wellbore increases to above the pressure in the formation adjacent the lost circulation zone, and the particles again become wedged in the perforations to reform a flow barrier across the layer of material. In one example the particles of bridging agent have different sizes. The method optionally further includes mounting packers on opposing ends of the liner. In an embodiment, the perforations each have a diameter that reduces with distance from the inner radius to define a smaller diameter and a larger diameter, and where particles of the bridging agent range in size from a smaller size with a diameter greater than the smaller diameter of the perforations to a larger size with a diameter that is less than the larger diameter of the perforations. The layer of material can be a planar layer that is rolled into a configuration having an annular axial cross section, or can be a tubular member and is unfolded to have a reduced outer periphery when being disposed in the wellbore and adjacent the lost circulation zone, and which unfolds into a tubular member having an outer surface in contact with an inner surface of the wellbore.

Another method of wellbore operations includes providing a wellbore liner having a tubular shape with an inner radius and an outer radius and perforations extending through a sidewall of the liner, disposing the liner in the wellbore and adjacent a location where fluid flow communicates between the wellbore and a formation adjacent the wellbore, providing a fluid with entrained particles of a bridging agent, the particles having diameters less than diameters of the perforations, and creating a flow barrier across the liner by flowing the fluid through the perforations and along an inner surface of the wellbore liner so that the entrained particles become deposited in the perforations and accumulate in the perforations to block fluid flowing through the perforations from within the liner. Example liners include a planar layer rolled into annular member, and a tubular member. In one example the step of flowing the fluid through the perforations includes ejecting the fluid from nozzles on a drill bit disposed in the wellbore, where the fluid ejected from the drill bit nozzles flows upward in the wellbore between an annular space formed by walls of the wellbore and an outer surface of a drill string on which the drill bit is mounted.

BRIEF DESCRIPTION OF THE DRAWINGS

Some of the features and benefits of that in the present disclosure having been stated, and others will become apparent as the description proceeds when taken in conjunction with the accompanying drawings, in which.

DETAILED DESCRIPTION

Figure 2:
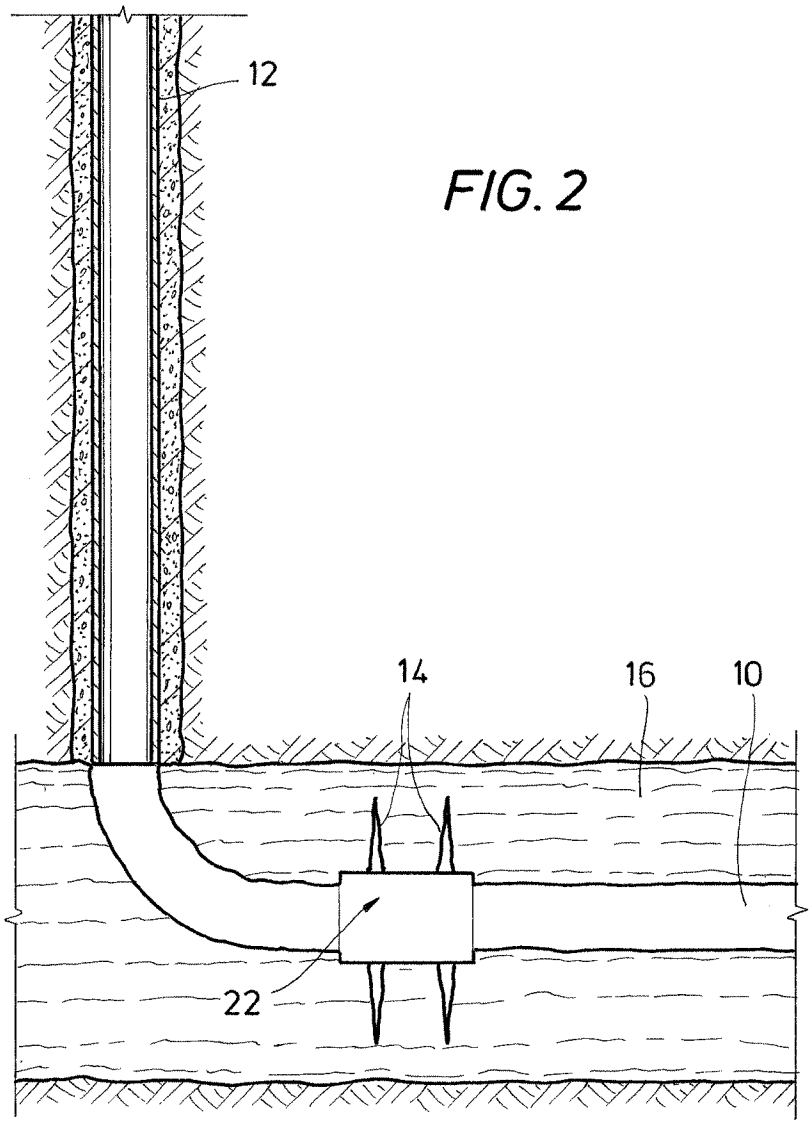
FIG. 2 is a side partial sectional view of an example embodiment of the borehole of FIG. 1 having a section with an enlarged diameter.
Figure 1:
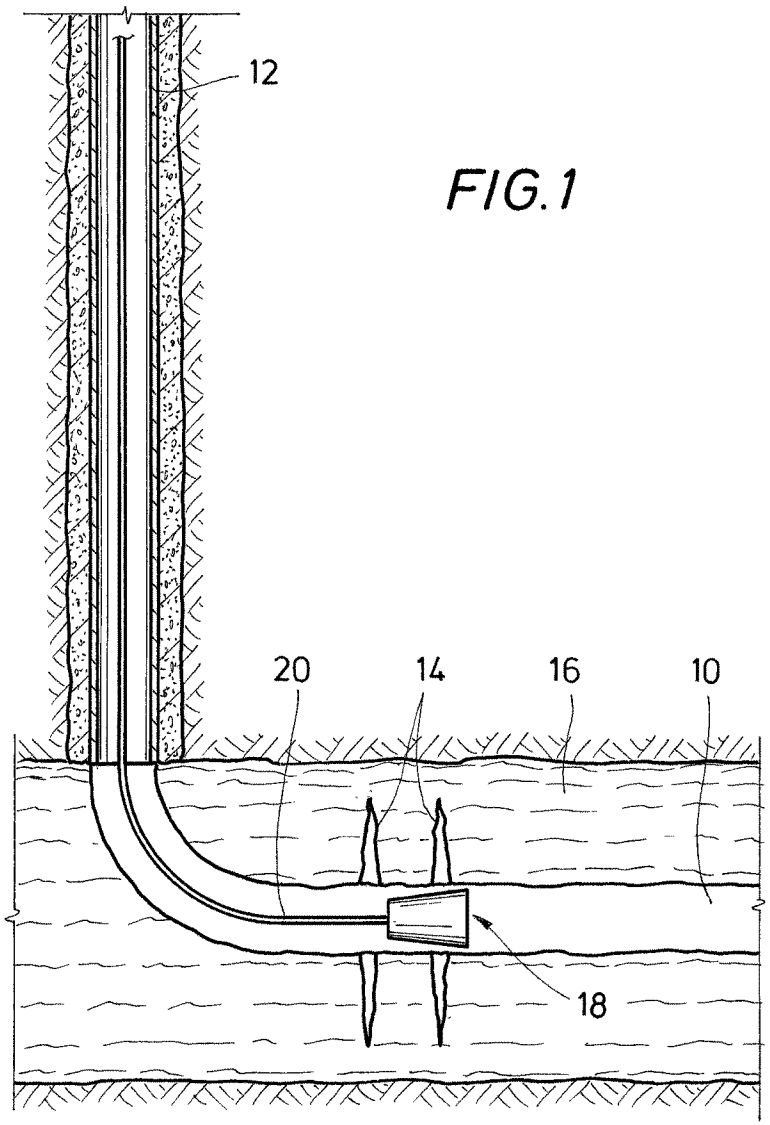
FIG. 1 is a side partial sectional view of an example embodiment of under-reaming a portion of a borehole.
Figures 3, 4:
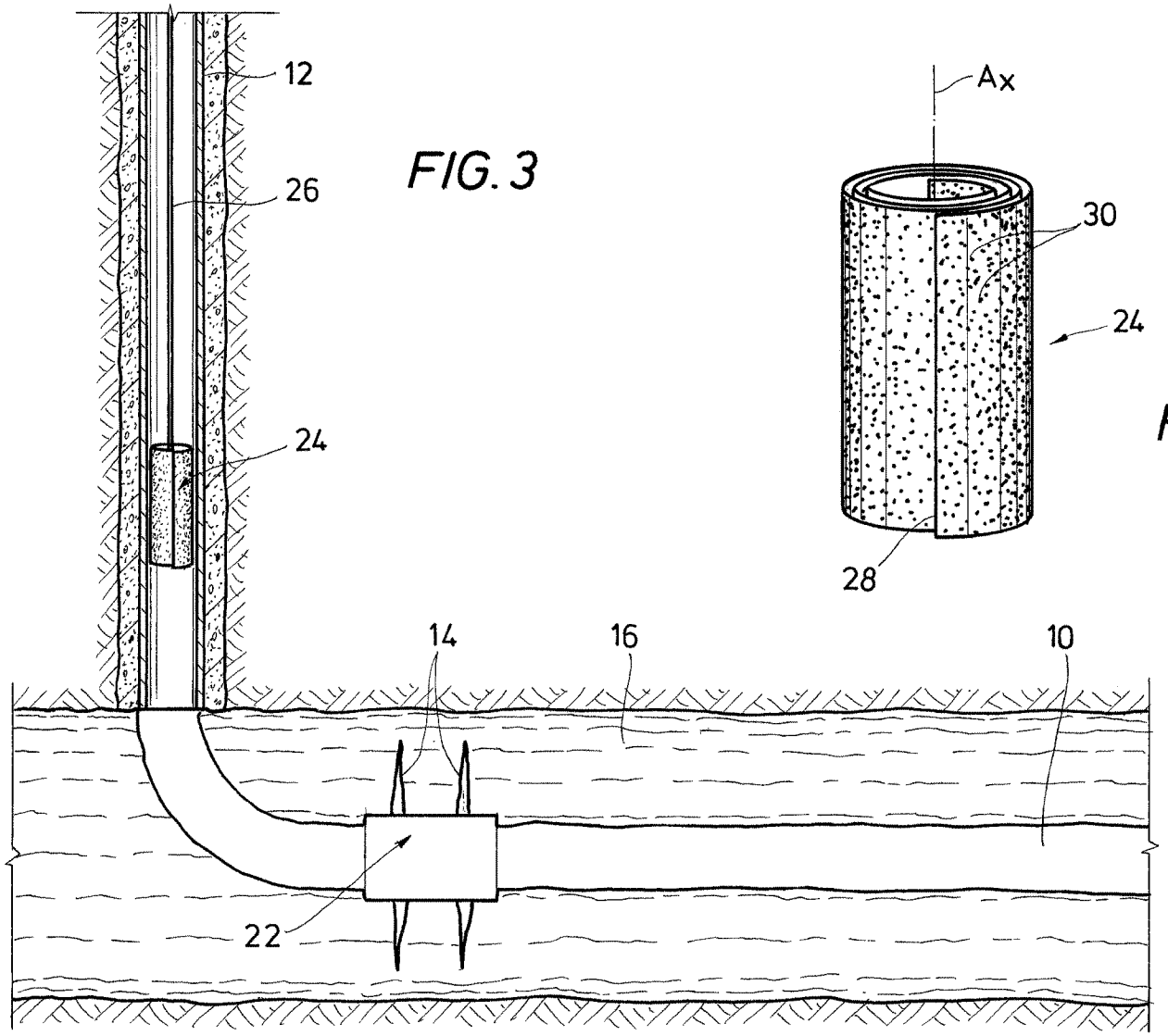
FIG. 3 is a side partial sectional view of a liner being lowered in the borehole of FIG. 2.
FIG. 4 is a side perspective view of the liner of FIG. 3.

FIG. 1 illustrates a side sectional view of an example of a wellbore 10 having a portion lined with casing 12. An unlined portion of the wellbore 10 is shown extending past a lower terminal end of the casing 12. Optionally, the entire wellbore 10 may be unlined. In the example wellbore 10, fissures 14 extend laterally from walls of an unlined portion of the wellbore 10 and into formation 16 surrounding the wellbore 10. The fissures 14 introduce fluid communication means between the wellbore 10 and formation 16 to create a lost circulation zone. In one example a lost circulation zone is defined where fluids in the wellbore 10 flow into the formation 16 and vice versa. For the purposes of discussion, any amount of flow between the wellbore 10 and formation 16 can be deemed to define a lost circulation zone, e.g. from seepage (detectable or not) to substantially all flow being injected into the wellbore. FIGS. 1-3 depict an example embodiment of a method for isolating the fissures 14 from the wellbore 10 to minimize or eliminate loss of circulation from the wellbore 10 to the formation 16. Referring back to FIG. 1, a drill bit 18 and drill string 20 are shown in the wellbore 10, where the drill bit 18 is suspended on a lower end of a drill string and adjacent the fissures 14. In the example of FIG. 1, the drill bit 18 can be an under reamer type.

As illustrated in FIG. 2, the drill bit 10 of the example method bit has been disposed past the fissures 14 and drawn back up the wellbore 10 while engaging the walls of the wellbore 10. This removes a portion of the formation 16 and produces an enlarged bore section 22 adjacent the fissures 14, which has a diameter greater than other sections of the wellbore 10. Further in the example embodiment and as illustrated in FIG. 3, a liner 24 is shown being lowered into the wellbore 10 on a lower end of a conveyance member 26. Examples of conveyance members include wireline, jointed work string, drill pipe, tubing, and coiled tubing. Optionally, the liner 24 can be deployed using a tractor (not shown).

An example embodiment of the liner 24 is shown in more detail in a side perspective view in FIG. 4. In the example of FIG. 4, the liner 24 is a planar element 28 that is wrapped or rolled into an annular configuration. Perforations 30 are illustrated formed through the planar element 28, so that even when in the rolled configuration a fluid flow path extends between an axis Ax of the liner 24, through each layer making up the liner 24, and outer surface of the liner 24. As such, fluid within the liner 24 can, over time, make its way through the perforations 30 into the outer surface of the liner 24. Example liners 24 include a sheet of flexible material, a wire mesh, and any planar member that can be rolled into an annular configuration. Example materials of the liner 24 include metals, composites, and combinations thereof.

Figure 5:
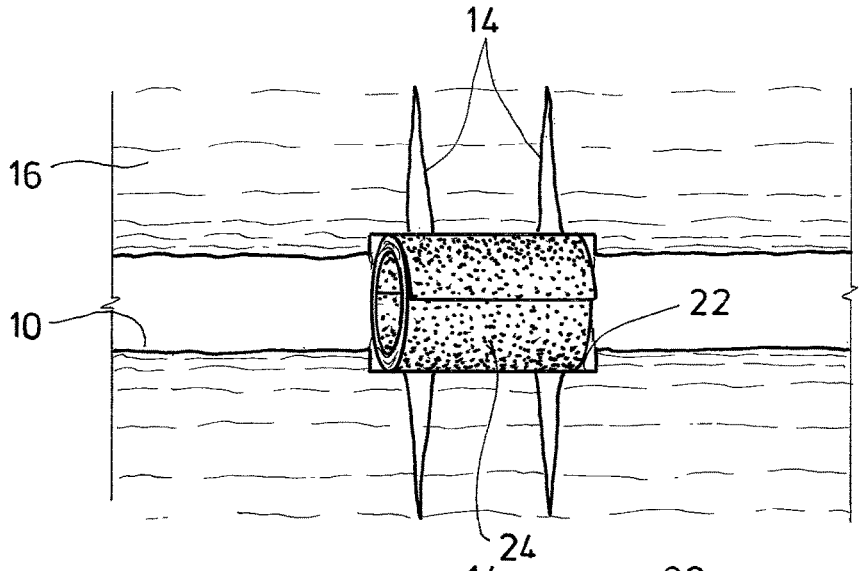
FIG. 5 is a side partial sectional view of the liner being set in the enlarged diameter portion of the borehole of FIG. 3.

Referring now to FIG. 5, a side partially sectional and perspective view example of the liner 24 is shown disposed within the enlarged bore section 22. In the example of FIG. 5, the conveyance member 26 (FIG. 3) has been uncoupled from the liner 24 after being used to position the liner 24 within the enlarged bore section 22. Further in the example of FIG. 5, the liner 24 is radially expanded over its configuration of that in FIG. 3. In the example of FIG. 3, the diameter of the wellbore 10 exceeds the diameter of the liner 24 by an amount so the liner 24 can freely pass through the wellbore 10. Radially expanding the liner 24 as illustrated in the example of FIG. 5, contacts the outer surface of the liner 24 against the wall of the wellbore 10 within the enlarged bore section 22. Moreover, the outer surface of the liner 24 is set adjacent where the fissures 14 interface with the wellbore 10, thus in the path of any fluid communication between the wellbore 10 and fissures 14.

Figure 6:
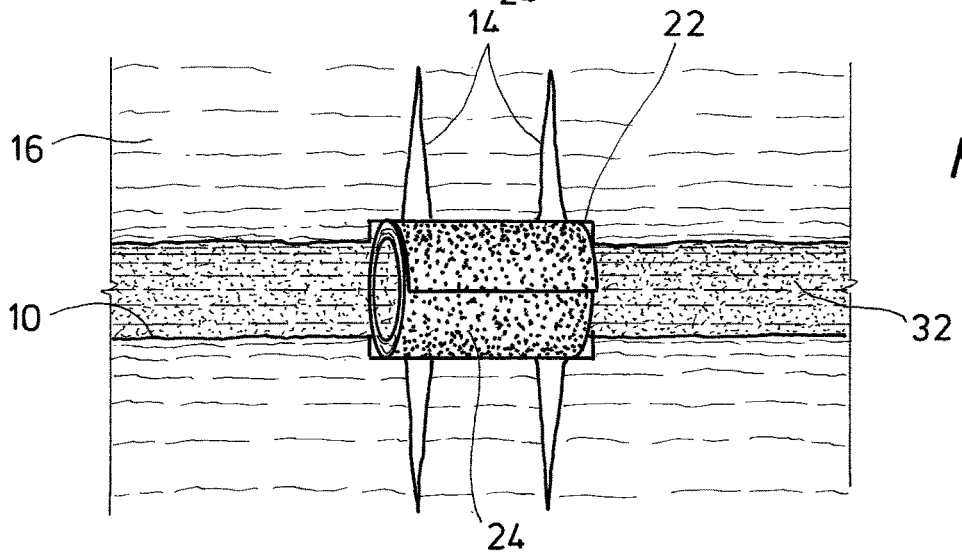
FIG. 6 is a side partial sectional view of a bridging agent being included in the borehole of FIG. 5.

As illustrated in FIG. 6, a bridging agent 32 may optionally be provided in the wellbore 10. In one embodiment the bridging agent 32 includes particles of a finite size and diameter that are suspended in drilling mud, or other fluid, and injected into the wellbore 10. In instances when lost circulation takes place across the enlarged bore section 22, the mud or fluid in the wellbore 10, with its entrained bridging agent 32 flows into the perforations 30 in the liner 24. In one example, the diameters of the perforations 30 are greater than diameters of the particles in the bridging agent 32. Thus the particles of the bridging agent 32 become deposited in the perforations 30 when the mud flows through the perforations 30. Over time, the particles accumulate in the perforations 30 and ultimately block fluid flowing through the perforations 30 from within the liner 24. In this manner, the bridging agent 32 forms a flow barrier across the liner 24 thereby remediating lost circulation from the wellbore 10 into the formation 16 adjacent the enlarged bore section 22. In the example of FIG. 6, the bridging agent 32 has accumulated over the area where the liner 24 interfaces with the fissures 14. In an embodiment, the presence of the bridging agent 32 on an inner surface of the liner 24 forms a mudcake or filtercake. Examples of the bridging agent 32 include calcium carbonate, suspended salt, or oil soluble resins. The bridging agent 32 can also optionally include various solids such as mica, shells, or fibers.

The combination of the liner 24 and bridging agent 32 can provide a one-way flow barrier to restrict mud loss from the wellbore 10 into the formation 16. In an example, should pressure in the wellbore 10 drop below pore pressure within the formation 16, the bridging agent 32 in the perforations 30 of the liner 24 does not block flow from the formation 16 into the wellbore 10. Instead, fluid flowing from the formation 16 and impinging the outer surface of the liner 24 can dislodge the particles of the bridging agent 32 from the perforations 30. Without the bridging agent 32 plugging fluid flow through the liner 24, the fluid exiting the formation 16 can flow through the perforations 30 and into the wellbore 10 without urging the liner 24 radially inward. Because the liner 24 is selectively permeable and allows flow from the formation 16 to pass across its sidewalls through the perforations 30, the liner 24 can remain in place when the wellbore 10 is underbalanced. This is a distinct advantage over other known drilling liners that are not permeable and are subject to collapsing in response to fluid inflow during underbalanced conditions. Embodiments exist where the liner 24 is set in the wellbore 10 without first underreaming, or where the liner 24 is set in the wellbore 10 in locations without fractures, cavities, or other vugular occurrences.

Figure 7:
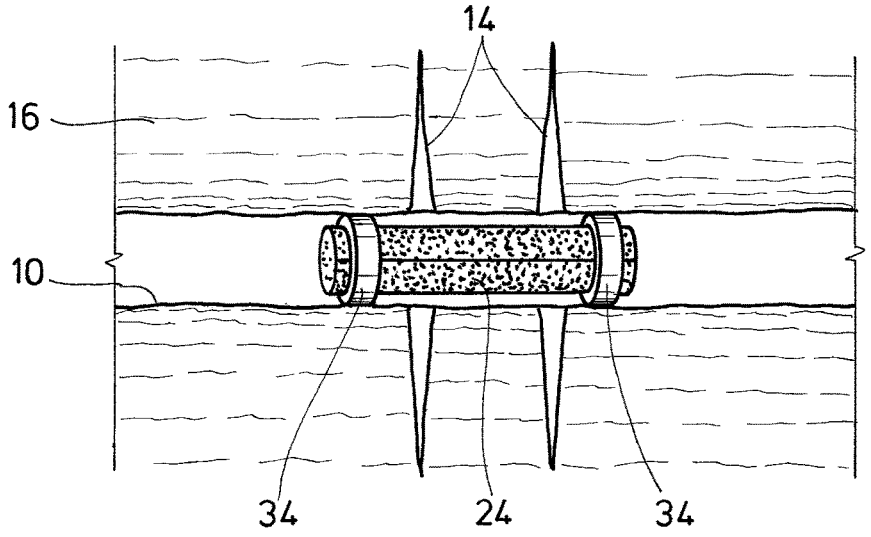
FIG. 7 is a side partial sectional view of an alternate embodiment of the liner in the enlarged diameter portion of the borehole of FIG. 5.

FIG. 7 provides in a side partial sectional and perspective view an alternate embodiment of the method of treating the lost circulation zone. In FIG. 7, a liner 24 is shown set in the wellbore 10 adjacent the fissures 14 in the formation 16; packers 34 are provided on ends of the liner 24. The packers 34 of FIG. 7 are strategically positioned to be on either side of the fissures 14 so that any cross-flow between the wellbore 10 and formation 16 is directed through the liner 24. The packers 34 prevent fluid from flowing along a path between the walls of the wellbore 10 and outer surface of the liner 24. By diverting substantially all cross flow between the wellbore 10 and fissures 14 through the liner 24, the packers 34 ensure a level of permability is maintained between the wellbore 10 and formation 16.

Figure 8A:
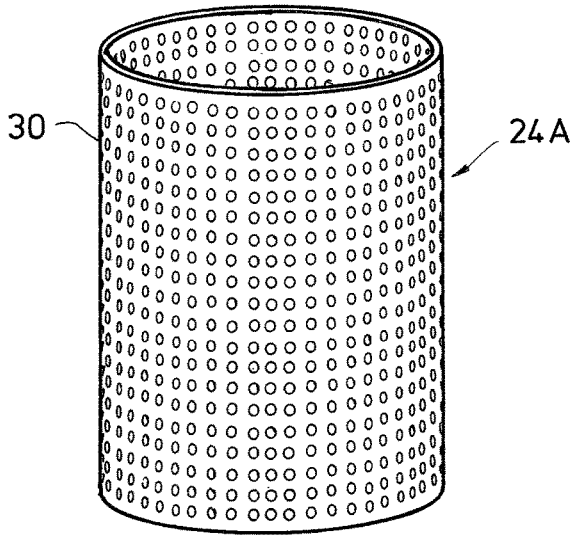
FIGS. 8A-8C are perspective and end views of alternate embodiments of the liner of FIG. 4.
Figure 8B:
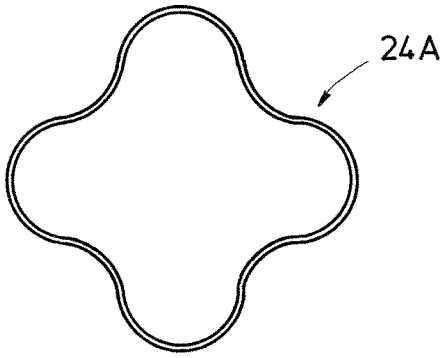
Figure 8C:
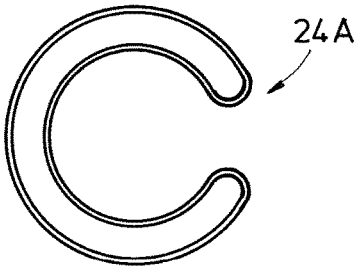

FIG. 8A provides a perspective view of an alternate embodiment of a liner 24A that is a tubular member, and may be optionally have a diameter substantially the same as the diameter of the enlarged bore section 22. Like the liner 24 of FIG. 4, the liner 24A of FIG. 8 includes perforations 30; but instead of being a wound or rolled up planar element, the liner 24A is a tubular member having a continuous outer diameter. FIGS. 8B and 8C are axial end views of the liner 24A of FIG. 8A contorted for insertion into the wellbore 10. As shown in the end view in FIG. 8B, the liner 24A can be reshaped by urging selected portions of its outer circumference radially inward. The outer periphery of the liner 24A of FIG. 8B has a star like profile. Another alternate embodiment of a configuration is shown in FIG. 8C where opposing sides of the liner 24A are pushed towards one another thereby flattening the cross-section of the liner 24A, and then the opposing distal ends are brought towards one another so that when viewed from the end, the liner 24A takes on a "C" shaped member. The star or "C" shaped configurations each reduce the outer diameter of the liner 24A and allow insertion of the liner 24A through the casing 12 and wellbore 10 for ultimate placement of the liner 24A into the enlarged bore section 22. After being reshaped, a retaining means (not shown) can be applied onto the liner 24A and removed when the liner 24A is adjacent the enlarged bore section 22 thereby freeing the liner 24A to expand radially outward and into position within the enlarged bore section 22. Moreover, a retaining means can also be applied to the liner 24 of FIG. 4 and removed when the liner 24 is adjacent the enlarged bore section 22.

Figure 9:
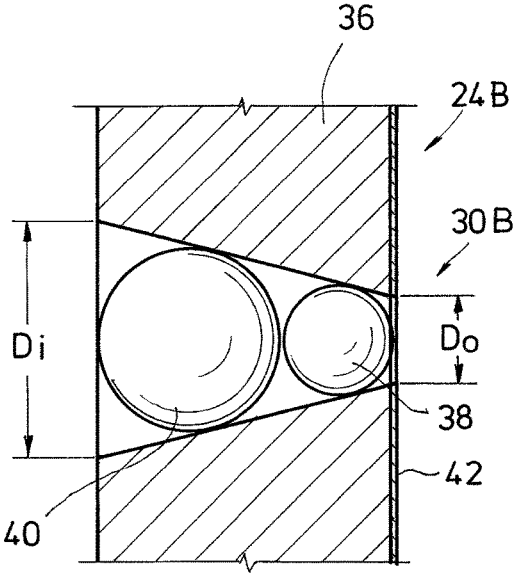
FIG. 9 is a side sectional view of an alternate embodiment of a perforation formed through a liner.

Shown in FIG. 9 is a side sectional view of an alternate embodiment of a perforation 30B projecting through a sidewall 36 of the liner 24B. In this example the diameter of the perforation 30B slopes radially inward from a value of $D_i$ at an inner radius of the liner 24B, to a lower value of $D_o$ at an outer radius of the liner 24B. Further illustrated in FIG. 9 is that the bridging agent 32 optionally includes particles 38, 40 that have diameters of varying sizes designated for use in different wellbores having different pore distributions. In an example, the smaller sized particles 38 are designated for a first wellbore, a portion of which has a formation pore distribution that can be classified as "normal", i.e., is not vugular or highly permeable and does not include fractures, fissures, or cavities. Conversely, the larger sized particle 40 can be designated for a second wellbore with a larger normal pore distribution. In the example of FIG. 9, the diameter $D_o$ is less than the diameter of smaller particle 38 and diameter $D_i$ is greater than the diameter of larger particle 40. An advantage of $D_i$ being greater than the diameter of the larger particle 40, and $D_o$ being smaller than the diameter of the smaller particle 38, is that both sized particles 38, 40 may enter the perforation 30B from inside of the liner 24B, but cannot pass through the perforation 24B. Thus in one example of use, liners 24B with the same design and same sized perforations 30B can be used in the different wellbores having different sized pore distributions, and in conjunction with bridging agents 32 that include different sized particles, without the need to resize the perforations 30B.

In an alternate example, the wall of the wellbore 10 has zones with different sized pore distributions. In this example, the smaller particle 38 is designated for use in a smaller pore distribution in the wellbore, and the larger particle 40 is designated for a larger pore distribution in the wellbore. As such, the liner 24B of FIG. 9 is capable of forming a selectively impermeable barrier when both of the different sized particles 38, 40 are deployed in the same wellbore 10. It should be pointed out that embodiments exist where the bridging agent 32 includes particles having more than two different diameters, and the perforations 30B in the liner 24B can retain the particles having more than two different diameters. Moreover, embodiments exist where the contour of the perforations 30B through the sidewall 36 is non-linear, instead, the contour can be stepped or curved.

Yet further optionally provided in the example of FIG. 9 is an anchoring layer 42 shown illustrated on the outer radius of the liner 24B. Examples of material for the anchoring layer 42 include conventional or fluid swellable elastomeric compounds. In this example the anchoring layer 42 is substantially pliable to facilitate anchor friction and end sealing of the liner 24B.

The present disclosure therefore is well adapted to carry out the objects and attain the ends and advantages mentioned, as well as others inherent. While embodiments of the disclosure have been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method of operations in a wellbore having a lost circulation zone comprising:

providing a layer of material that is retained in an annular configuration and that has perforations;

disposing the layer of material in the wellbore and adjacent the lost circulation zone;

expanding the layer of material radially outward and into contact with the lost circulation zone to define a tubular member having an inner radius and an outer radius, and to provide communication between the wellbore and the lost circulation zone through the perforations in the layer of material; and injecting fluid into the wellbore that flows to within the inner radius, through the perforations, and into the lost circulation zone, the fluid having particles of a bridging agent entrained within that deposit and that accumulate in the perforations as the fluid flows through the perforations to block flow through the perforations and form a flow barrier across the layer of material.

2. The method of claim 1, where a conveyance member is used for disposing the layer of material in the wellbore, and where the conveyance member is removed from the wellbore prior to the step of injecting fluid into the wellbore.

3. The method of claim 1, where the bridging agent comprises calcium carbonate.

4. The method of claim 3, where when a pressure in a formation adjacent the lost circulation zone exceeds a pressure in the wellbore, the particles are wedged from the perforations to enable flow from the outer radius to the inner radius and remove the flow barrier from across the layer of material, and the layer of material remains in contact with the lost circulation zone, where when the pressure in the wellbore increases to above the pressure in the formation adjacent the lost circulation zone, and the particles again become wedged in the perforations to reform a flow barrier across the layer of material.

5. The method of claim 1, where the particles of bridging agent have different sizes.

6. The method of claim 1, further comprising mounting packers on opposing ends of the layer.

7. The method claim 1, where the perforations each have a diameter that reduces with distance from the inner radius to define a smaller diameter and a larger diameter, and where particles of the bridging agent range in size from a smaller size with a diameter greater than the smaller diameter of the perforations to a larger size with a diameter that is less than the larger diameter of the perforations.

8. The method of claim 1, where the layer of material comprises a planar layer that is rolled into a configuration having an annular axial cross section.

9. The method of claim 1, where the layer of material is tubular member and is unfolded to have a reduced outer periphery when being disposed in the wellbore and adjacent the lost circulation zone, and which unfolds into a tubular member having an outer surface in contact with an inner surface of the wellbore.

10. The method of claim 1, where particles of the bridging agent are dislodged from the perforations when fluid flows from the lost circulation zone back into the wellbore.

11. A method of wellbore operations comprising:

providing a wellbore liner having a tubular shape with an inner radius and an outer radius and perforations extending through a sidewall of the liner;

disposing the liner in the wellbore and adjacent a lost circulation zone and so that communication between the wellbore and the lost circulation zone is provided through the perforations;

providing a fluid with entrained particles of a bridging agent, the particles having diameters less than diameters of the perforations; and creating a flow barrier across the liner by flowing the fluid through the perforations and along an inner surface of the wellbore liner so that the entrained particles become deposited in the perforations and accumulate in the perforations to block fluid flowing through the perforations from within the liner.

12. The method of claim 11, where the configuration of the liner comprises a shape selected from the list consisting of a planar layer rolled into annular member and a tubular member.

13. The method of claim 11, where the step of flowing the fluid through the perforations comprises ejecting the fluid from nozzles on a drill bit disposed in the wellbore, where the fluid ejected from the drill bit nozzles flows upward in the wellbore between an annular space formed by walls of the wellbore and an outer surface of a drill string on which the drill bit is mounted.

* * * * *